US006866010B2

(12) United States Patent
May

(10) Patent No.: US 6,866,010 B2
(45) Date of Patent: Mar. 15, 2005

(54) METHOD OF REDUCING SMOKE AND PARTICULATE EMISSIONS FROM COMPRESSION-IGNITED RECIPROCATING ENGINES OPERATING ON LIQUID PETROLEUM FUELS

(75) Inventor: Walter R. May, Houston, TX (US)

(73) Assignee: SFA International, Inc., Houston, TX (US)

( * ) Notice: Subject to any disclaimer, the term of this patent is extended or adjusted under 35 U.S.C. 154(b) by 0 days.

(21) Appl. No.: 10/192,261

(22) Filed: Jul. 10, 2002

(65) Prior Publication Data

US 2003/0015456 A1 Jan. 23, 2003

Related U.S. Application Data

(60) Provisional application No. 60/304,579, filed on Jul. 11, 2001.

(51) Int. Cl.[7] ..... F02B 75/12; C01L 1/30

(52) U.S. Cl. ..... 123/1 A; 208/15; 44/354

(58) Field of Search ..... 123/1 A, 198 A; 208/15; 44/355, 356, 359, 354

(56) References Cited

U.S. PATENT DOCUMENTS

| | | | | | |
|---|---|---|---|---|---|
| 3,615,292 | A | * | 10/1971 | Badin | 44/363 |
| 3,891,401 | A | * | 6/1975 | Watson et al. | 44/359 |
| 3,994,699 | A | * | 11/1976 | Scott | 44/320 |
| 4,505,718 | A | | 3/1985 | Dorer, Jr. | |
| 4,659,338 | A | | 4/1987 | Johnston et al. | |
| 4,690,687 | A | | 9/1987 | Johnston et al. | |
| 5,145,488 | A | | 9/1992 | Weber et al. | |
| 5,266,082 | A | * | 11/1993 | Sanders | 44/357 |
| 5,667,751 | A | * | 9/1997 | Taylor, Jr. | 420/8 |
| 5,858,942 | A | * | 1/1999 | Adams et al. | 510/185 |
| 5,944,858 | A | * | 8/1999 | Wallace | 44/359 |
| 6,051,040 | A | * | 4/2000 | Peter-Hoblyn | 44/358 |
| 6,488,725 | B1 | | 12/2002 | Vincent et al. | |

FOREIGN PATENT DOCUMENTS

| | | |
|---|---|---|
| CN | 1184146 | 6/1998 |
| CN | 1222561 | 7/1999 |
| GB | 2091291 A | 7/1982 |
| GB | 2248068 A | 3/1992 |

OTHER PUBLICATIONS

Edited by Eliot, Boiler Fuel Additives for Pollution Reduction and Energy Savings, 1978, pp. 67–72.
Rising, B., Particulate Emission Reduction Using Additives, Technical Paper TP–98010, Jan. 9, 1998, Westinghouse Power Corp., Orlando, FL 32826–2399.
Dr. Walter May, Combustion Turbine Exhaust Particulate Emission Reduction: A Mechanistic Discussion, dated Jun. 2002.

* cited by examiner

*Primary Examiner*—Andrew M. Dolinar
*Assistant Examiner*—Katrina B. Harris
(74) *Attorney, Agent, or Firm*—Karen B. Tripp

(57) ABSTRACT

A method of reducing smoke and particulate emissions from an exhaust gas from a compression-ignited reciprocating engine by adding a fuel additive that contains an oil-soluble iron compound and an over-based magnesium compound to liquid petroleum fuel.

25 Claims, No Drawings

METHOD OF REDUCING SMOKE AND PARTICULATE EMISSIONS FROM COMPRESSION-IGNITED RECIPROCATING ENGINES OPERATING ON LIQUID PETROLEUM FUELS

RELATED APPLICATIONS

This application claims the benefit of provisional application with the U.S. Ser. No. 60/304,579, filed on Jul. 11, 2001, which hereby is incorporated by reference in its entirety.

BACKGROUND OF THE INVENTION

1. Technical Field

The present invention relates in general to a combustion catalyst for diesel and in particular to a catalyst containing an over-based magnesium compound combined with a soluble iron compound. Such catalyst is particularly useful in compression-ignited reciprocating engines operating on diesel fuel.

2. Description of the Prior Art

The effects of various metals listed above are known to improve combustion in boilers and combustion turbines and metals are known to vary ash quality. Useful first row transition metals from the periodic table include iron, manganese and copper. Also, various alkaline earth metals (barium, calcium) and others such as cerium, platinum and palladium have been tested. Manganese is most widely used as a combustion catalyst in boilers with residual oil, which often contains fuel contaminants, such as vanadium. Platinum and palladium, generally found in catalytic converters, are quite expensive. Manganese, when used alone, also forms low melting deposits and negates effects of magnesium on control of vanadium/sodium/calcium/potassium deposits. Iron catalyzes sulfur trioxide formation from sulfur dioxide increasing "cold end" corrosion (exhaust area) and sulfuric acid "rain" problems. Copper is less effective than either iron or manganese. Calcium forms tenacious deposits with other contaminant metals. Barium forms toxic salts. Cerium is not considered effective because of its higher elemental weight. These metals have been demonstrated to reduce smoke by no more than 50% at concentrations of up to about 50 PPM on a weight/weight basis by Environmental Protection Agency Test Method 5 (EPC M-5). Stability of the metal molecules is also not at issue and therefore not tested in boiler and turbines.

Combustion turbine engines are known to produce an excessive amount of smoke emissions and particulate matter during the start-up cycle due to unstable combustion, particularly when kerosene fuels are used. This can be due to large-sized fuel droplets resulting in inefficient combustion. Oil-soluble iron compounds reduce smoke emission from combustion turbine exhausts by up to 80% at iron concentrations of up to 30 PPM when such engines are operated on liquid petroleum fuels. This has been demonstrated in a combustion turbine engine, such as a Westinghouse Model D501-F 150 MW engine. An iron oxide dispersion product is known to reduce smoke emissions in combustion turbine engines. The dispersion product reached maximum smoke reduction at 55 ppm iron (Fe) as compared with an oil soluble product that reached a maximum reduction at 30 ppm Fe. This can be attributable to the difference between an oil-soluble solution of the iron product at the molecular level compared with a dispersion product having an average particle size of 0.5 to 1.0 micrometer.

Dispersion-type manganese (Mn) and iron (Fe) compounds have been used to reduce smoke emissions in low-speed (150–400 rpm) marine diesel engines. However, these compounds produce solid material in the gaseous phase. Marine diesel engines are capable of tolerating such gaseous phase solid materials because such engines have large piston and bore size tolerances as compared with higher speed diesel engines. Moreover, marine diesel engines consume large amounts of crankcase oil in the combustion process, which may help to reduce solid material accumulation. Medium (450–1,000 rpm) and high speed (>1,000 rpm) engines cannot tolerate high levels of contamination of crankcase oil from combustion products. However, dispersion-type manganese and iron compounds have not been shown to have any synergistic relationship for combustion catalysis.

Over-based magnesium (Mg) compounds are known in the art for converting trace metal contaminants into high melting compounds and reducing deposits in combustion turbine engines operated by liquid petroleum fuels containing trace metal contaminants such as vanadium, lead, sodium, potassium and calcium. These contaminants form low melting point corrosive deposits on hot metal parts in reciprocating engines, such as low-speed marine diesel engines. Magnesium is known to form high-melting salts with vanadium, sodium and other fuel contaminants. As a result, over-based magnesium compounds are used alone as fuel additives for compression-ignited reciprocating engines to reduce the effects of these contaminants. For example, an over-based magnesium compound has been used alone in a Wartsilla V32 18 cylinder 8 MW stationary diesel engine, to alleviate the effects of deposits and corrosion from the residual oil fuel used. However, there are no known magnesium-containing fuel additives for diesel engines, which reduce smoke and particulate emissions.

Heretofore, there has not been a fuel additive for reducing smoke and particulate emissions from high speed (>1,000 rpm), high-compression reciprocating engines, such as diesel engines. There is a need for a fuel additive that includes a combustion catalyst to reduce smoke and particulate emissions from bus, truck and automobile diesel engines operating on diesel fuels, such as refined No. 2 grade fuels.

The present invention meets this and other needs. It is an object and goal of the current invention to reduce smoke emissions and particulate matter from high-speed, high-compression reciprocating engines, such as diesel engines.

It is an object and goal to create an additive that does not result in the formation of precipitates. It is an object and a goal to create a soluble iron additive that remains stable during the combustion process. It is an object and a goal to create an additive for hydrocarbon fuel that reduces level of NOx produced.

SUMMARY OF INVENTION

The present invention advantageously provides a method of reducing smoke and particulate emissions from compression-ignited reciprocating engines, such as medium- and high-speed diesel engines, operating on a liquid petroleum fuel such as diesel. This method includes adding a fuel additive to the liquid petroleum fuel. The additive preferably contains an oil-soluble iron compound and an over-based magnesium compound. In this form, the fuel additive preferably shows a ration of 5:1 iron to magnesium on a weight basis. A preferred embodiment includes the additive containing from about 3 parts to about 8 parts iron per about 1 part magnesium, by weight. Alternately, the fuel additive contains from about 4 parts to about 7 parts iron per about 1 part magnesium. When the fuel additive is added to the liquid petroleum fuel, the iron content is preferably in the range of 30–70 PPM by weight with 50 PPM being particularly preferred. Smoke and particulate emissions from diesel engines are reduced by more than 90 percent using the composition and method of this invention.

The additive is suitable for use in compression-ignited reciprocating engines such as diesel engines that operate at about 400 to 1,000 rpm to about 1,000 to 6500 rpm.

The invention includes a method of catalyzing combustion of a liquid petroleum fuel in a compression-ignited reciprocating engine including adding an oil-soluble iron compound and an over-based magnesium compound to said liquid petroleum fuel; and whereby said engine has improved engine performance, increased engine horsepower produced and increased fuel efficiency.

Use of the additive of the invention in hydrocarbons to be combusted also is a method of reducing NOx emissions from hydrocarbon-burning processes.

DETAILED DESCRIPTION OF THE PREFERRED EMBODIMENT OF THE PRESENT INVENTION

It has been shown that iron behaves as a true catalyst based on kinetic theory. In related works, it has been found that oil-soluble iron combined with oil-soluble magnesium is a very effective combustion catalyst in compression-ignited (diesel) reciprocating engines. The synergistic mixture of metals results in suppression of hydrocarbons in the exhaust (soot or smoke) and 8 to 12% increase in fuel efficiency.

Oil-soluble organic iron and magnesium compounds reduce smoke emission from combustion turbine exhausts by up to 80% at iron concentrations of up to 30 PPM when such engines are operated on liquid petroleum fuels. This has been demonstrated in a combustion turbine engine, such as a Westinghouse Model D501-F 150 MW engine. Combustion turbine engines are known to produce an excessive amount of smoke emissions and particulate matter during the start-up cycle due to unstable combustion. This may be due to large-sized fuel droplets resulting in inefficient combustion. An iron oxide dispersion product is known to reduce smoke emissions in combustion turbine engines, along with the negative side effects noted above. The dispersion product reached maximum smoke reduction at 55 PPM iron (Fe) as compared with the oil-soluble iron product that reached a maximum reduction at 30 PPM Fe. This may be attributable to the difference between a oil-soluble solution of the iron product at the molecular level compared with a dispersion product having an average particle size of 0.05 to 0.5 micrometer.

The iron-magnesium combination has a very high activity level, especially at the 50 PPM iron (Fe) treatment level. An examination of the spectra of magnesium, iron, copper and manganese reveals that the spectra lines of magnesium compliment the spectra lines of iron. There are no duplicates or reinforcements. The magnesium spectra, alone, do not yield energy in the areas that will continue burning of hydrocarbons after the temperature is quenched. However, it is believed that the magnesium spectra are synergistic with the spectra of iron to give an energy quanta (packets) that support and continue reaction of hydrocarbon with oxygen after the temperature is quenched below temperatures that would normally support combustion. Therefore, magnesium supports the catalytic effect of iron in a synergistic fashion that results in the catalyst being much more effective than iron alone. The longer burning time results in cooler temperatures resulting in lower NOx formation.

The composition of one embodiment of this invention is an oil-soluble iron compound and an over-based magnesium compound. This composition catalyzes combustion of liquid petroleum fuels in compression-ignited reciprocating engine, such as diesel engines, when added to such fuels. The catalyzed combustion results in improved engine performance, increased engine horsepower produced and increased fuel efficiency.

Diesel engines present a significantly different situation from combustion turbines, process heaters and steam boilers in that diesel engines are reciprocating piston engines. Energy from the fuel comes from a series of discreet "explosions" rather than a constant burning system. Diesel engines also present a challenge with possible problems with piston rings scoring cylinder walls, the piston crown, valves, valve seats and turbochargers. As a result, it is not a natural progression from combustion turbines, process heaters and steam boilers to Diesel engines.

Further, high-speed automotive Diesel engines present significantly different problems from low speed Marine engines or medium-speed stationary power plant engines. This is because of the higher speed of the rings traveling on the cylinder walls, and opening of the valves per unit time. Dispersion or slurry-type fuel additives are known to produce solid materials that would cause serious abrasion and wear on engine parts, which would rapidly lead to engine failure.

While the additive has been tested with iron to magnesium around a ratio of 5:1 by weight, this is a preferred embodiment. Magnesium is preferably between 0.1 and 3 in this ratio to iron.

The method of reducing smoke and particulate emissions from an exhaust gas from a compression-ignited reciprocating engine operating on a liquid petroleum fuel includes adding a fuel additive to said liquid petroleum fuel. The fuel additive preferably comprises a oil-soluble iron compound and an over-based magnesium compound.

The composition of this invention includes a fuel additive, which contains about 3.0 to 8.0 parts iron by weight for about 1.0 part magnesium by weight. Preferably, the fuel additive contains from 4.0 to about 7.0 parts iron by weight for 1.0 part magnesium by weight. More preferably, the fuel additive contains from about 5.0 parts iron by weight, for about 1 part magnesium by weight.

The oil-soluble compounds of iron of this invention are selected from iron carboxylate, dicarboxylate, sulfonate, phosphonate and sandwich compound such as dicyclopentadienyl and dicyclopentadienyl-carbonyl and mixtures thereof. The iron carboxylates are made from carboxylic acids preferably containing eight or more carbon atoms for oil solubility.

The preferred over-based magnesium compounds of this invention are selected from carboxylate, sulfonate, acetic and mixtures thereof. The term "over-based" refers to the excess amount of base as compared with the acid of the solution, the acid being provided by the carboxylic acid, sulfonic acid or acetic acid of the preferred embodiment. The over-based magnesium compound preferred for this invention is magnesium oxide in a stable colloidal dispersion, the magnesium oxide being in such a proportion as to be greater than the amount that the acid of the additive solution could neutralize.

EXAMPLE 1

The fuel additive composition can also be formulated as a concentrate, which preferably contains about 5.5% iron by weight and about 1.1% magnesium by weight. Dilutions of this concentrate can be made for convenience of use.

To treat 100 liters of diesel fuel, the weight of the diesel fuel to be treated is 80 kg, based on a density of 0.8 gm/cc. For an iron concentration of 50 PPM Fe, the amount of oil-soluble iron needed is about 4 gm. Fe. Sufficient oil-soluble iron and over-based magnesium compounds are added to the fuel so that about 4 gm. of iron are added for about 100 liters of fuel.

Other volumes and/or weights can be used to treat a given volume and/or weight of fuel with an variety of concentrations of the fuel additive. This fuel additive has been tested in passenger vehicles having diesel engines, such as a pickup truck, a minivan, and in commercial vehicles, such as intra- and inter-city buses and over-the road trucks.

EXAMPLE 2

The oil-soluble iron compound of this invention can be prepared in a single batch in laboratory quantities. The apparatus required is a 3-Neck round bottom 1,000 ml. flask, heating mantle, temperature controller, 0–400° C. thermometer, stirrer center mounted with a motor and controller, condenser and vacuum pump with trap.

The reactants are as follows:

| | |
|---|---|
| Iron Oxide | 79 gms. |
| Carboxylic acid (MW > 200) | 720 gms |
| High Boiling Process Solvent | 215 gms |

The apparatus is assembled with the thermometer in one outside neck and the stirrer in the center. A condenser is connected to the flask in the reflux position. An high boiling solvent, such as carboxylic acid with a molecular weight of greater than 200 gr/gr. mole, is added to the to the reactor and heated to 90° C. Iron oxide is then added and heated to 110° C. Carboxylic acid, with a molecular weight that is greater than 45 gram/gram-mole, is added and heated to 140° C. The contents are then refluxed for one hour. The water of reaction, from the reaction with the carboxylic acid, is then removed. The contents are then heated to greater than 200° C. until the high boiling solvent and water are removed. When water stops evolving, the condenser is placed in the distillation position, a vacuum is applied and the remaining solvent is removed. The high boiling solvent and/or HAN or No. 2 fuel is returned to the condenser to reach the desired iron concentration.

EXAMPLE 3

The over-based magnesium compound of this invention can be prepared in a single batch in laboratory quantities. The apparatus required is a 3-Neck round bottom 1,000 ml. flask, heating mantle, temperature controller, 0–400° C. thermometer, center-mounted stirrer with a motor and controller, condenser and vacuum pump with trap.

The reactants are as follows:

| | |
|---|---|
| Magnesium hydroxide | 195 gms. |
| Sulfonic acid (MW > 200) | 37 gms. |
| Carboxylic acid (MW > 200) | 99 gms. |
| Carboxylic acid (MW > 45) | 2 gms. |
| High Boiling Process Solvent | 215 gms. |
| High aromatic solvent | 138 gms. |

The apparatus is assembled with the thermometer in one outside neck and the stirrer in the center. A condenser is connected to the flask in the reflux position. An high boiling solvent, such as carboxylic acid with a molecular weight of greater than 200 gram/gram-mole, is added to the to the reactor and heated to 90° C. Magnesium is then added and heated to 110° C. Carboxylic acid, with a molecular weight that is greater than 45 gram/gram-mole, is added and heated to 140° C. The contents are then refluxed for one hour. The water of reaction, from the reaction with the carboxylic acids, is then removed. The contents are then heated to greater than 280° C. until the high boiling solvent and water are removed. When water stops evolving, the condenser is placed in the distillation position, a vacuum is applied and the remaining solvent is removed. The high boiling solvent and/or HAN or No. 2 fuel is returned to the condenser to reach the desired magnesium concentration.

While the degree of purity of the additive has not been examined for effect, the additive was created as described above to achieve high purity for purposes of scientific testing. The present invention has several advantages. Smoke and particulate emissions from compression-ignited reciprocating engines are reduced by over about 90%, based on visual observations, using the method and oil-soluble iron and over-based magnesium composition of this invention. Compression-ignited reciprocating engines, which use the method and composition of this invention also, produced increased horsepower during vehicle acceleration and operate more smoothly with less vibration and "knocking". Further, the fuel efficiency of such engines also increased from a minimum of 10% to as much as 20%. In empirical field tests, there have been no reports of maintenance problems or damage to the engine as a result of using a fuel additive containing the composition of this invention.

To use the additive, a mixture is formed with the diesel or other fuel prior to combustion. Any traditional method of adding the additive is encompassed herewith. For example, the additive can be added in-line as the fuel is pumped to the engine. This typically requires accurate metering pumps that change pumping rate with fuel use. A more common method is mixing the additive into the fuel, such as diesel, at any point following refining up to the final fuel tank.

This invention avoids the use of toxic metals such as lead in engine exhausts. Ferric oxide resulting from combustion of the catalyst is rust, a widely prevalent material in nature that is totally benign to biological life forms. Other methods of practicing the invention would be other chemical forms of the product and introducing to the fuel through different techniques.

While the present invention has been described and/or illustrated with particular reference to a combustion catalyst for compression-ignited reciprocating engines, such as diesel engines, operating on liquid petroleum fuels, it is noted that the scope of the present invention is not restricted to the particular embodiment(s) described. It should be apparent to those skilled in the art that the scope of the invention includes the use of the combustion catalyst in other reciprocating engines than those specifically described. Moreover, those skilled in the art will appreciate that the invention described above is susceptible to variations and modifications other than those specifically described. It is understood that the present invention includes all such variations and modifications which are within the spirit and scope of the invention. It is intended that the scope of the invention not be limited by the specification, but be defined by the claims set forth below.

It is claimed:

1. A method of reducing smoke and particulate emissions from an exhaust gas from a compression-ignited reciprocating engine operating on a liquid petroleum fuel, comprising the step of: adding a fuel additive to the liquid petroleum fuel the fuel additive comprising:

an oil-soluble iron compound; and an over-based magnesium compound, and wherein the fuel additive contains from about 3 parts to about 8 parts iron per about 1 part magnesium, by weight.

2. The method of claim 1, wherein the oil-soluble iron compound is selected from the group consisting of an iron carboxylate, dicarboxylate, sulfonate, phosphonate, dicyclopentadienyl, dicyclopentadienyl-carbonyl, sandwich compounds and mixtures thereof;

and wherein the over-based magnesium compound is selected from the group consisting of carboxylate, sulfonate and mixtures thereof.

3. The method of claim 1, wherein the fuel additive contains from about 4 parts to about 7 parts iron per about 1 part magnesium, by weight.

4. The method of claim 1, wherein the fuel additive contains about 5 parts iron per about 1 part magnesium, by weight.

5. The method of claim 1, wherein said liquid petroleum fuel contains about 50 PPM of iron, based on weight, after adding the fuel additive.

6. The method of claim 1, wherein the smoke and particulate matter in the exhaust gas are reduced by at least 90 percent by weight.

7. The method of claim 1, wherein the compression-ignited reciprocating engine is a diesel engine that operates at about 400 to 1,000 rpm to about 1,000 to 6500 rpm.

8. The method of claim 1, wherein the liquid petroleum fuel comprises a diesel fuel.

9. A method of catalyzing combustion of a liquid petroleum fuel in a compression-ignited reciprocating engine, comprising the step of:

adding an oil-soluble iron compound and an over-based magnesium compound to the liquid petroleum fuel operable to combust in a compression-ignited reciprocating engine; and whereby the engine has improved engine performance, increased engine horsepower produced and increased fuel efficiency, and wherein the emission of smoke and particulate matter in the exhaust gas is reduced by at least 90 percent by weight.

10. The method of claim 9, wherein the oil-soluble iron compound is selected from the group consisting of an iron carboxylate, dicarboxylate, sulfonate, phosphonate, dicyclopentadienyl, dicyclopentadienyl-carbonyl, sandwich compounds and mixtures thereof; and the over-based magnesium compound is selected from the group consisting of carboxylate, sulfonate and mixtures thereof.

11. The method of claim 9, wherein the fuel additive contains from about 3 parts to about 8 parts iron per about 1 part magnesium, by weight.

12. The method of claim 9, wherein the fuel additive contains from about 4 parts to about 7 parts iron per about 1 part magnesium, by weight.

13. The method of claim 9, wherein the fuel additive contains about 5 parts iron per about 1 part magnesium, by weight.

14. The method of claim 9, wherein the liquid petroleum fuel contains about 50 PPM of iron, based on weight, after adding the fuel additive.

15. The method of claim 9, wherein the compression-ignited reciprocating engine is a diesel engine that operates at about 400 to 1,000 rpm to about 1,000 to 6500 rpm.

16. The method of claim 9, wherein the liquid petroleum fuel comprises a diesel fuel.

17. A compression-ignited reciprocating engine fuel additive that reduces smoke and particulate emissions by at least 90 percent by weight during engine operation, the fuel additive comprising an oil-soluble iron compound and an over-based magnesium compound, having a ratio of about 3 parts to about 8 parts iron per about 1 part magnesium, by weight.

18. The fuel additive of claim 17, wherein the oil-soluble iron compound is selected from the group consisting of an iron carboxylate, dicarboxylate, sulfonate, phosphonate, dicyclopentadienyl, dicyclopentadienyl-carbonyl, sandwich compounds and mixtures thereof; and the over-based magnesium compound is selected from the group consisting of carboxylate, sulfonate and mixtures thereof.

19. The fuel additive of claim 17, wherein the compression-ignited reciprocating engine is a diesel engine that operates at about 400 to 1,000 rpm to about 1,000 to 6500 rpm.

20. The fuel additive of claim 19, wherein the fuel comprises a diesel fuel.

21. The fuel additive of claim 17, wherein the fuel additive contains from about 4 parts to about 7 parts iron per about 1 part magnesium, by weight.

22. The fuel additive of claim 17, wherein the fuel additive contains about 5 parts iron per about 1 part magnesium, by weight.

23. The fuel additive of claim 17, wherein the fuel comprises liquid petroleum and contains about 50 PPM of iron, based on weight, after adding the fuel additive.

24. A compression-ignited reciprocating engine fuel containing about 50 ppm of iron based on weight, and comprising liquid petroleum and a fuel additive comprising an oil-soluble iron compound and an over-based magnesium compound.

25. The compression-ignited reciprocating engine fuel of claim 24 wherein said fuel additive comprises about 3 parts to about 8 parts iron per about 1 part magnesium by weight.

* * * * *